US009815657B1

(12) United States Patent
Livingston

(10) Patent No.: US 9,815,657 B1
(45) Date of Patent: Nov. 14, 2017

(54) SPOOL HOLDING APPARATUS AND METHOD

(71) Applicant: Aaron Livingston, Ladysmith, WI (US)

(72) Inventor: Aaron Livingston, Ladysmith, WI (US)

( * ) Notice: Subject to any disclaimer, the term of this patent is extended or adjusted under 35 U.S.C. 154(b) by 5 days.

(21) Appl. No.: 15/266,568

(22) Filed: Sep. 15, 2016

(51) Int. Cl.
*B65H 49/32* (2006.01)
*B65H 57/10* (2006.01)

(52) U.S. Cl.
CPC ..... *B65H 49/321* (2013.01); *B65H 57/10* (2013.01); *B65H 2701/34* (2013.01); *B65H 2701/35* (2013.01); *B65H 2701/36* (2013.01)

(58) Field of Classification Search
CPC .. B65H 49/321; B65H 57/10; B65H 2701/35; B65H 2701/36; B65H 2701/34
See application file for complete search history.

(56) References Cited

U.S. PATENT DOCUMENTS 2,147,216 A * 2/1939 Raasch ..... B65H 49/321 242/129.6
2,382,968 A * 8/1945 Berman ..... B65H 49/305 242/401
3,902,679 A * 9/1975 Bost ..... B65H 49/02 242/125.1
4,172,608 A * 10/1979 Brown, Jr. ..... B65H 49/321 242/588
4,202,509 A * 5/1980 Horn ..... B65H 49/16 242/129
4,830,298 A * 5/1989 Van Blunk ..... B29C 53/8016 242/157 R
5,632,219 A * 5/1997 Fleming, Jr. ..... B63B 35/816 114/254
5,694,873 A 12/1997 Wu
6,086,013 A * 7/2000 Looney, Jr. ..... B65H 49/321 242/129.5
6,182,920 B1 * 2/2001 Watkins ..... B62B 3/022 242/594.4
6,422,504 B1 * 7/2002 Elder ..... B65H 49/32 211/85.5
7,124,980 B2 10/2006 Giovannoni
7,243,876 B2 * 7/2007 Robison ..... B65H 49/32 242/557
7,677,489 B2 3/2010 Phillips
7,721,985 B2 * 5/2010 Weissbrod ..... B23K 9/1333 242/129
2001/0030257 A1 * 10/2001 Fletcher ..... B65H 57/16 242/557
2002/0117574 A1 8/2002 Hawley
2007/0018031 A1 * 1/2007 Sycko ..... B65H 49/305 242/597.4
2014/0070045 A1 * 3/2014 Robinson ..... B65H 49/32 242/566
2015/0274405 A1 * 10/2015 Nahm ..... B65H 75/146 206/407

* cited by examiner

*Primary Examiner* — William A. Rivera
(74) *Attorney, Agent, or Firm* — Anthony J. Bourget

(57) ABSTRACT

A spool holding device configured to fold upon itself in a storage mode and to support a spool of wound material in an operation mode. The device includes a base upon which a pair of feet, a pair of legs, a hoop segment and a horizontal axis are detachably connected for quick set-up and take-down of the device. The hoop segment is positioned a clearance distance from the horizontal axis and includes a wide hoop through which the wound material may pass such that unwinding of the material without undue force is achieved; the hoop also includes a contact surface having a large bend radius.

20 Claims, 19 Drawing Sheets

SPOOL HOLDING APPARATUS AND METHOD

BACKGROUND OF THE INVENTION

1. Field of the Invention

This invention relates to the field of spool holding devices.

2. Background Information

Spool holding devices are used to support spools of wire or other wound products. Typically a spool is suspended to spin about an axle while the wire material is unwound as needed. A variety of different spool types and wound material are used, including spools of electrical wire, cable, telephone wire, rope, chain, or other wound products. The spool may vary in size, with spools being several inches in length or diameter to several feet in length or diameter. Examples of spool carrying devices for which patents have been sought or granted include U.S. Pat. No. 7,677,489, U.S. Pat. No. 7,243,876, U.S. Patent Application No. 2002/0117574 and U.S. Pat. No. 7,124,980.

While the prior systems have utility, there is room for improvement.

SUMMARY OF THE INVENTION

In one aspect the device of the present invention is configured to fold upon itself in a storage mode and to support a spool of wound material in an operation mode. The device includes a base upon which a pair of feet, a pair of legs, a hoop segment and a horizontal axle may be detachably connected for quick set-up and take-down of the device. The hoop segment is positioned a clearance distance from the horizontal axle and includes a wide hoop through which the wound material may pass such that unwinding of the material is accomplished without imparting undue force upon the device or upon the material.

In one aspect the device includes a hoop segment having an opening or openings positioned above a horizontal axle where the horizontal axle is configured to hold a spool of wound material such as cable, wire or the like, the opening configured to guide the cable when the cable is unwound from the spool. The opening may come in a variety of forms including as a hoop or hoops, with the hoop having a diameter substantially greater than the diameter of cable that is passed therethrough. In one aspect the opening or hoop is positioned a substantial distance above the spool, and in one example is positioned a distance above the horizontal axle at least the measure of the diameter of the spool. The device is configured such that a spool supported by the device is free to move horizontally along the horizontal axle to provide a natural and/or optimal angle in which the cable exits the opening or hoop.

In further aspects the holding device includes a base which supports the device in an operation mode and receives the device components in a compact storage mode.

The above partial summary of the present invention is not intended to describe each illustrated embodiment, aspect, or every implementation of the present invention. The figures and detailed description and claims that follow more particularly exemplify these and other embodiments and further aspects of the invention.

Figure 1:
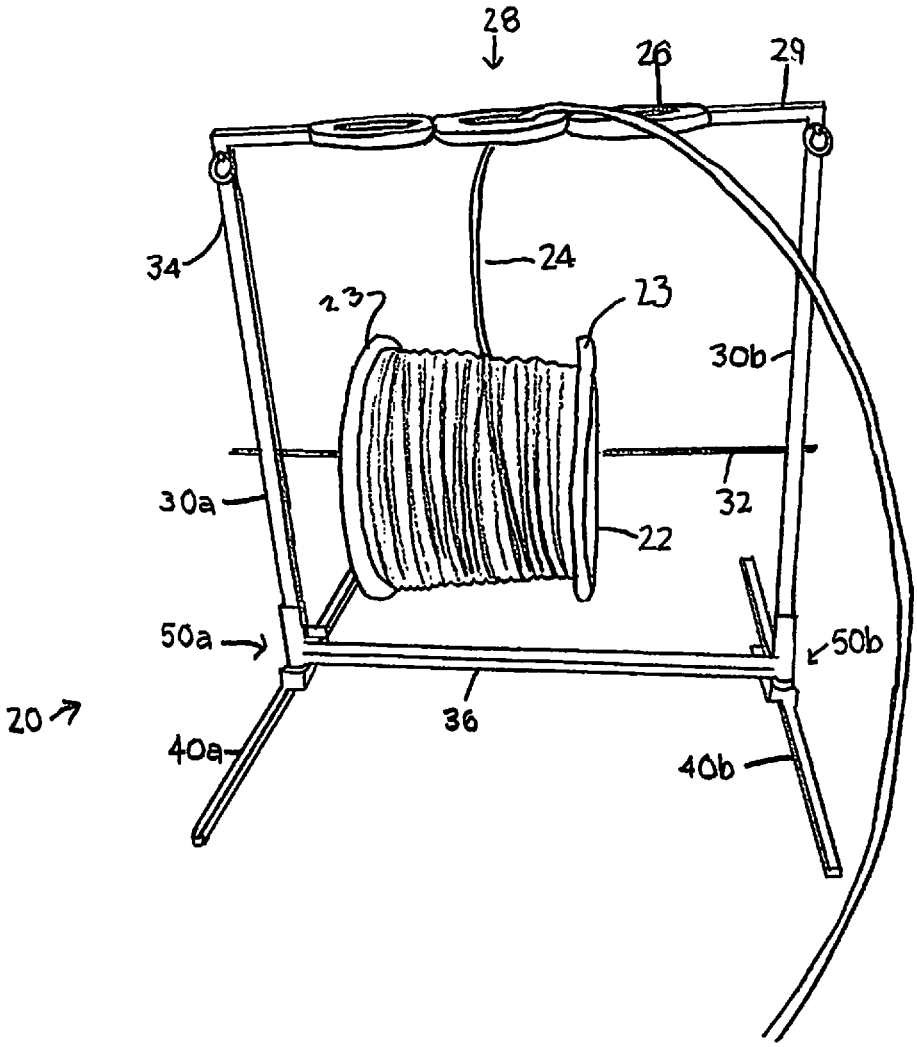
FIG. 1 is a front view of a spool holder made in accordance with one aspect of the present invention and holding a spool of wire.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Referring to FIGS. 1-19, aspects of the spool holding device are shown. In one aspect, device 20 is a spool holder configured to hold a spool 22 of cable or electrical wire or other wound material. Electrical wire or cable 24 is wound around spool 22 and is fed through hoop 26. In one aspect, a spool 22 of cable 24 measures 12 to 20 inches long, typically about 14 inches long, with a spool wheel 23 diameter of about 13 to 16 inches, typically about 14 inches in diameter. Different dimensions of spools 22 may be used. Spool 22 may hold cable, wire or other objects to be wound. In one aspect device 20 has one or more hoops 26. In one aspect hoops 26 are welded together. As shown in FIG. 1, three hoops 26*a*, 26*b* and 26*c* are connected together. For welding purposes, hoops 26 are double layered (shown in FIG. 2). For instance, a hoop 26 may comprise a first ring 27*a* connected to a second ring 27*b* (See FIG. 12). As shown in FIGS. 2, 9, and 11-13, the first ring 27*a* is stacked upon second ring 27*b* to form a hoop 26 made of two stacked rings. Such double ring structure allows for efficient welding or connecting of one hoop 26 to another adjacent hoop 26 and to hoop bar 29. Such double ring structure also allows for a desired thickness (and large bend radius) of the hoop 26 to accommodate a non-binding or buckling action when dispensing cable 24 along or past hoop 26. As described in further detail below, having a relatively thick hoop (and great bend radius) imparts less bending strain on cable 24. Hoops 26 or other parts of device 20 may be made of plastic or other materials including composite materials. In the case of plastic hoops 26, there may not be a need for a double ring structure. As described below, a single layer or single piece plastic hoop 26 will have a relative large thickness (and bend radius) to accommodate desired non-bending of a cable passing therethrough.

FIG. 1 shows device 20 in its operational mode. Spool 22 sits on horizontal axle 32. Electrical wire or cable 24 is fed through a hoop 26 in a hoop segment 28 located above spool 22. As cable 24 is dispensed, spool 22 can slide back and forth on horizontal axle 32. Where cable 24 is wound on spool at a position closer to wheel 23, for instance, spool 22 may translate along horizontal axle 32. As cable 24 is unwound from spool 22 the point of removal of cable 24 from the spool 22 may vary from wheel 23 to wheel 23. Allowing spool to move from side-to-side along horizontal axle 32 provides a more efficient unwinding operation. Use of a hoop 26 having a relatively large diameter will lessen the need for sliding action of spool 22 along axle 32 (thus making device 20 less apt to tip; and easier for unwinding cable 24 because less force is required to simply spin spool 22 as opposed to both spinning and/or translating spool 22 along axle 32), and will also increase the range which spool 22 will be capable of traveling along axle 32. The translational motion of spool 22 along axle 32 provides a least (or lessened) amount of resistance when dispensing cable 24 by providing a more direct path from which cable 24 may be dispensed. A hoop 26 with a relatively large diameter promotes efficient dispensing of cable in that the wide hoop provides a greater range of angles from which cable 24 may be unwound from spool 22 which allows spool 22 to spin more easily. For instance, if the diameter of a hoop 26 were very small, the angles at which cable 24 may feed from spool 22 through hoop 26 are limited compared to the range of available feeding angles when the diameter of hoop 26 is greater (See FIG. 4, for instance). Also, with a relatively small diameter opening for hoop 26, the cable 24 would tend to restrict the exit of cable from the device toward a center/middle portion of the device even when the cable is being taken from the spool closer to a wheel 23 and therefore tending to cause the device to tip, The relatively wide diameter of hoop 26 promotes smooth unwinding. In one instance hoop 26 has a diameter such that a diameter of the opening in hoop 26 is at least three inches, and in one example the diameter is about 6 inches. In other aspects hoop 26 has a diameter greater than 6 inches. In one aspect, an opening in hoop 26 of at least three inches accommodates efficient use where device 20 is about 29-30 inches tall and has feet/foot 40 of about 29-30 inches. In further aspect and as shown in FIG. 1, hoop 26 has an inner opening of about 6 inches. A greater opening for hoop 26 is also contemplated for use with device 20.

Hoop 26 has a relatively large thickness. In one instance hoop 26 comprises two rings 27, each ring being a solid ½" metal rod formed into a ring with diameter of approximately 6 inches. Combining the rings makes for a 1 inch thick surface which provides a relatively large bending radius for hoop 26. For instance, when pulling cable 24, such as non-metallic sheathed cable, the bending radius should be no less than five times the diameter of the cable being pulled. Best practices and building or wiring codes require such large bending radius to assure the integrity of the cabling. In one aspect the thickness of hoop 26 is at least one inch and with a desired radius, thereby accommodating a bend radius of many cable varieties. The thickness and bend radius may be increased to accommodate further cables to assure a compliant installation of such cables. In some aspects the hoop 26 may be made of plastics to accommodate greater bend radius applications to assure compliance for all or a majority of cable gauge. Typically the smallest non-metallic sheathed cable is gauge 14-2 which has a diameter of about ⅜ inches. Configuring hoop 26 with a bend radius of at least ⅝ inches is desired. In one aspect the thickness of hoop 26 is between ¾ inch and 1 inch, and in further instances the thickness of hoop 26 at least 1 inch. Other applications may require a greater thickness to accommodate a greater bend radius, thus the thickness of hoop 26 in some cases is greater than 2 inches, with an appropriately configured bend radius. Hoop 26 may have greater thickness as described below in more detail.

Figure 4:
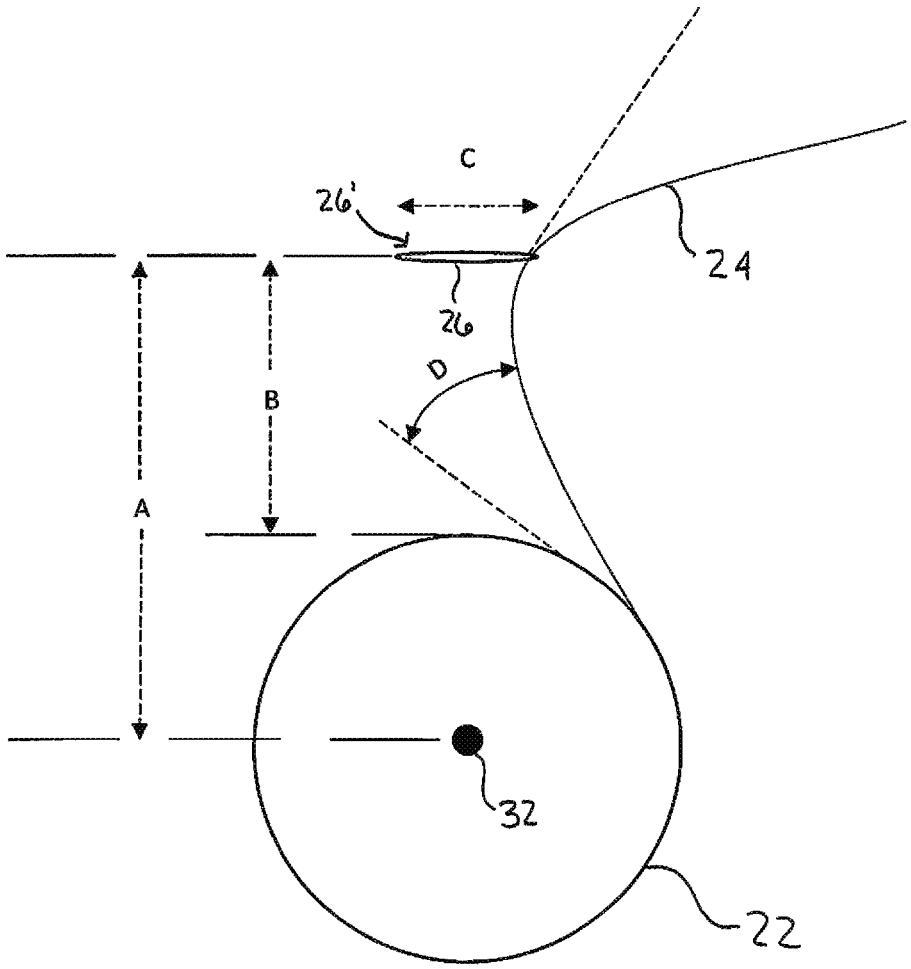
FIG. 4 is a schematic drawing of representative aspects of the device of FIG. 1.

It can be seen that hoop segment 28 is located a desired distance "A" above axle 32 (See FIG. 4) to assist in smooth unwinding of wire 24 from spool 22. In one aspect, segment 28 is positioned above the spool 22 greater than at least one-half the diameter of the spool 22. Positioning segment 28 at least such distance provides a desired clearance height "B" between hoop 26 and spool 22 (and/or the cable or wire wound upon spool 22) to accommodate efficient rotation of spool 22 when pulling upon cable 24. Such clearance height "B" allows for a sufficient torque force to be realized upon the spool 22, and together with the relatively large hoop diameter "C", creates a relatively large incident angle D as shown in FIG. 4. It may be appreciated that if diameter "C" is lessened and/or the clearance height "B" is lessened, the incident angle D would also lessen. Such lessening of the incident angle D results in a sharper bending of wire 24 about hoop 26—requiring a greater force to pull upon wire 24 for unwinding (and also impacting or potentially impacting the angel at which cable contacts hoop 26 and lies along or meets with the bend radius of hoop 26). It is a desire to minimize the force needed to pull wire 24 from device 20. Otherwise, a relatively high pulling force will tend to cause holder 20 to tip or slide (or the wire to experience unwanted forming or deformation along a tight bend radius). A relatively small incident angle also increases the potential for bending or crimping of wire 24 (also dependent on the bend radius of hoop 26).

Figure 8:
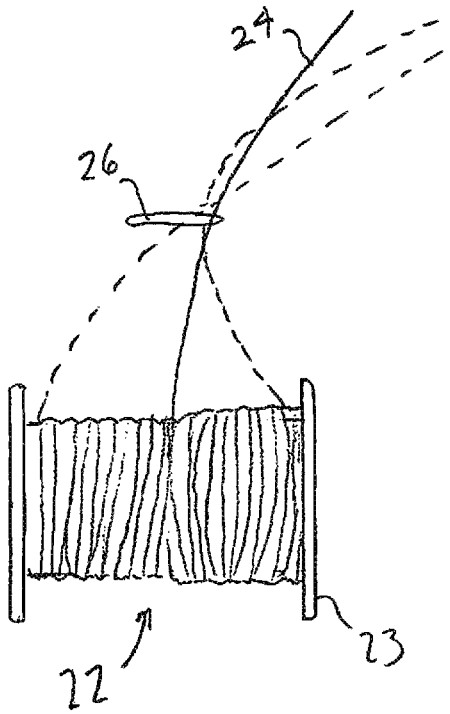
FIG. 8 is a schematic drawing of representative aspects of the device of FIG. 1.
Figure 9:
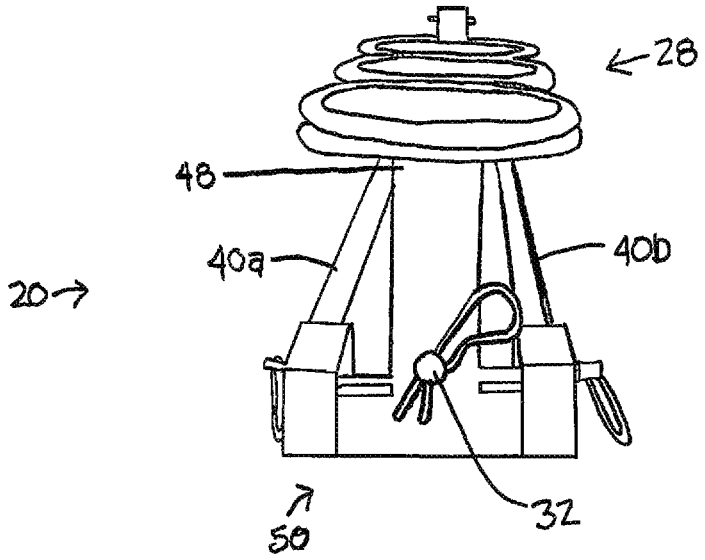
FIG. 9 is an end view of the device of FIG. 20 in a collapsed mode.
Figure 10:
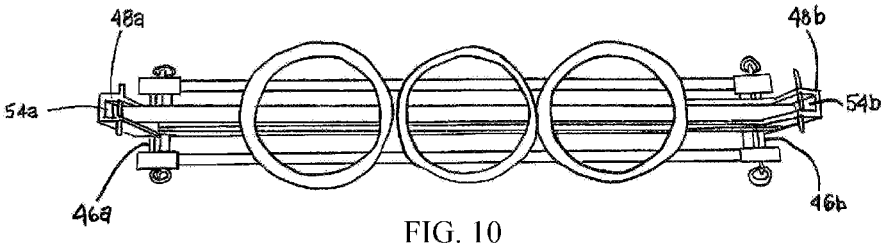
FIG. 10 is a top view of the folded frame device of FIG. 9.
Figure 11:
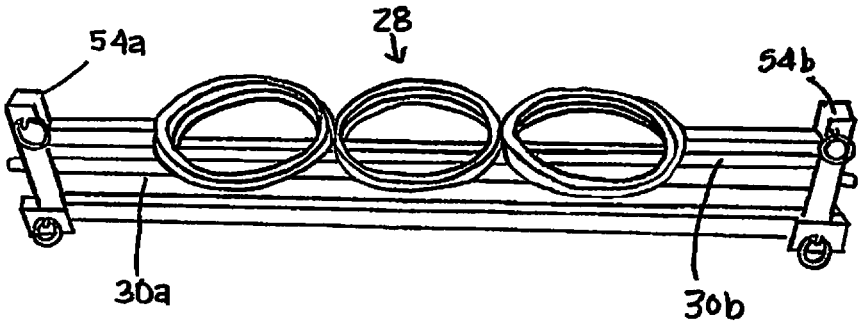
FIG. 11 is a front elevation view of the folded frame device of FIG. 9.
Figure 12:
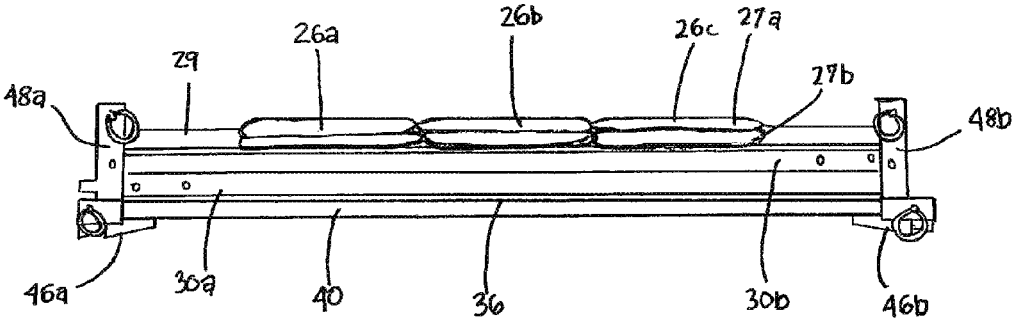
FIG. 12 is a front view of the folded frame device of FIG. 9.

Use of a relatively wide diameter hoop 26 and relatively long clearance height "B" also accommodates pulling of wire 24 from a variety of angles. Further, as the wire or cable 24 unwinds along the spool 22, the angle or positioning of the wire also adjusts. For instance, as cable is unwound from spool 22 as shown in FIG. 8, the position of the cable as it lifts from the spool will span from right to left along the spool 22. Having a wide hoop diameter and long clearance height "B" accommodates such changes so as to provide less severe angling of cable 24 compared to using smaller diameter hoops or positioning the hoop 26 closer to spool 22. Having two or more hoops 26 and even three hoops 26 provides additional variety and allows the wire 24 to pass through any of the hoops as desired. Moreover, multiple spools may be placed on the axle 32 and wire or cable fed through respective hoops 26. Spools of different wires may be placed on horizontal axle 32. For example, spools of phone cable, television cable and electric wire may be on horizontal axle 32 at the same time, each being dispensed out of a separate hoop 26. Multiple hoops 26 also accommodate for add-on structures such as hand roll mechanisms (non-spooled) which may clamp on to device 20.

As shown in FIG. 1, holder 20 has a generally rectangular configuration when assembled. Hoop segment 28 and horizontal axle 32 are supported by vertical legs 30*a*, 30*b*. Vertical leg 30 attaches to hoop bar 29 with a connector, such as connector 34 (for instance a connecter pin or detent pin). Hoop segment 28 includes a hoop bar 29 which and a plug 54*a*, 54*b*. Plug 54*a*, 54*b* is configured to plug into vertical leg 30 at a corner area of device 20. In one aspect plug 54 inserts into leg 30. In other aspects leg 30 may include a plug configured to insert into a plug receiver of hoop segment 28. Other connecting structures may also be used. Connector 34 may include a pin, bolt, screw, etc. Connector 34 allows for the quick assembly/disassembly of the device 20.

Figure 14:
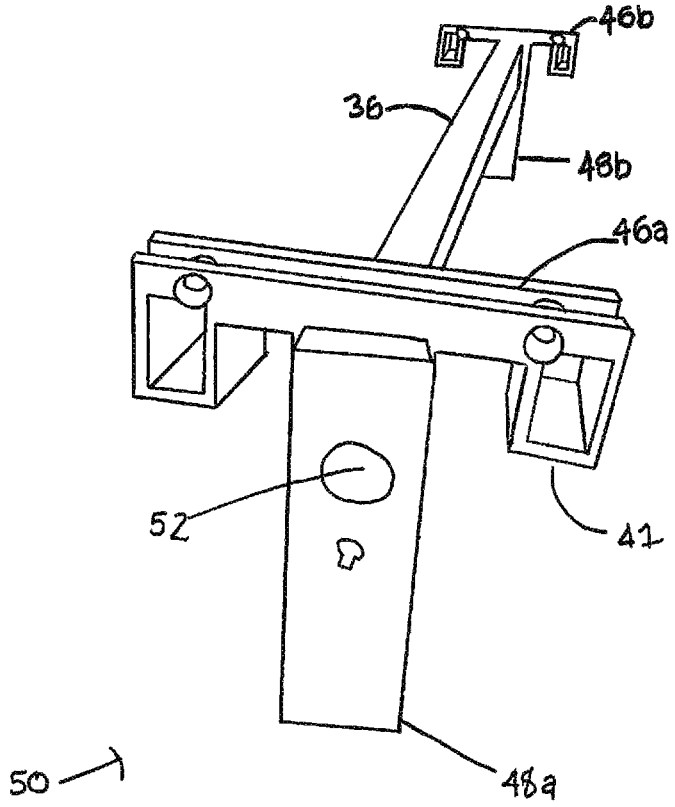
FIG. 14 is a partial bottom view of a feature of the device of FIG. 20.
Figure 15:
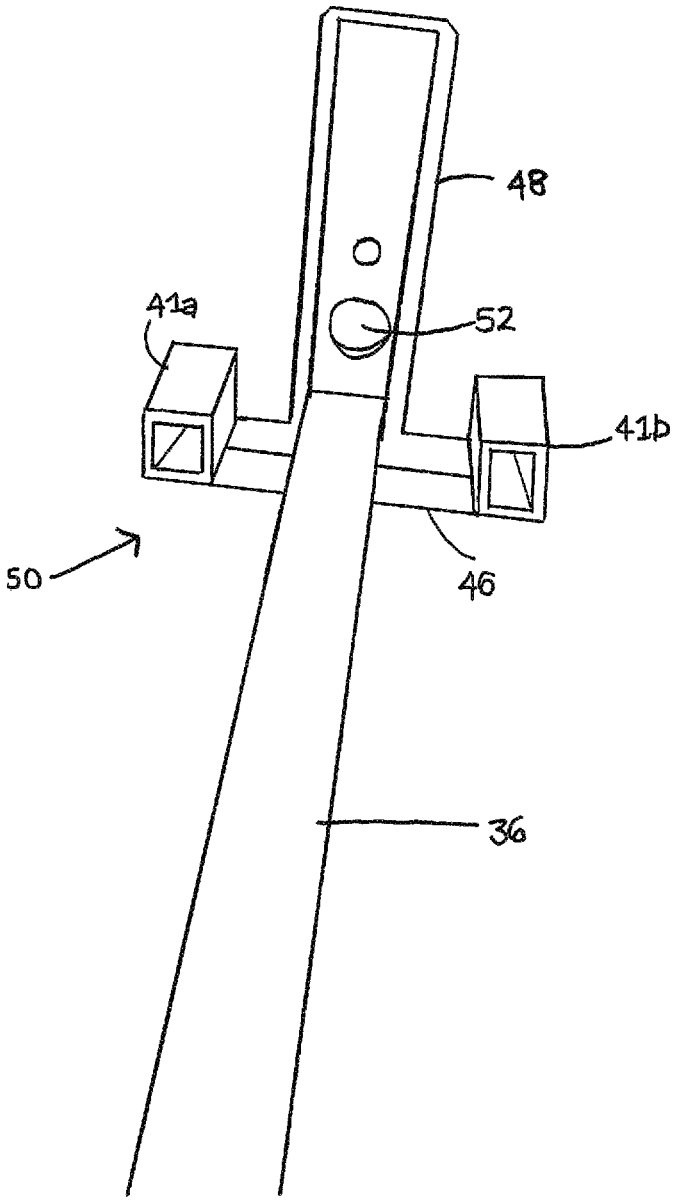
FIG. 15 is a reverse top view of the feature of FIG. 14.
Figure 16:
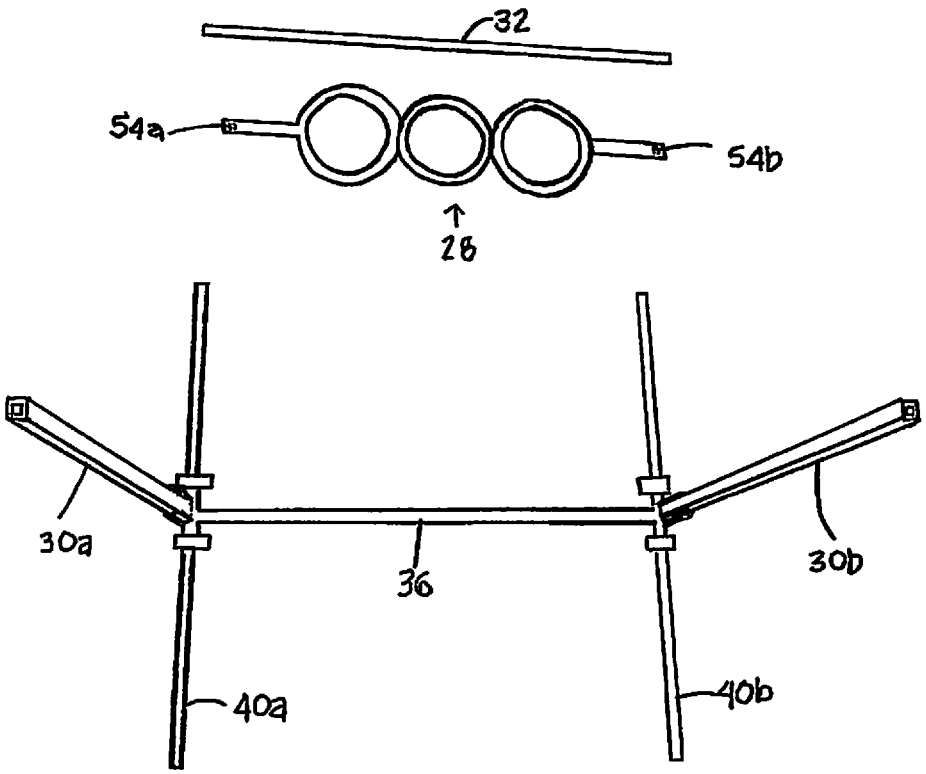
FIG. 16 is a partially exploded top view of the device of FIG. 20.
Figure 17:
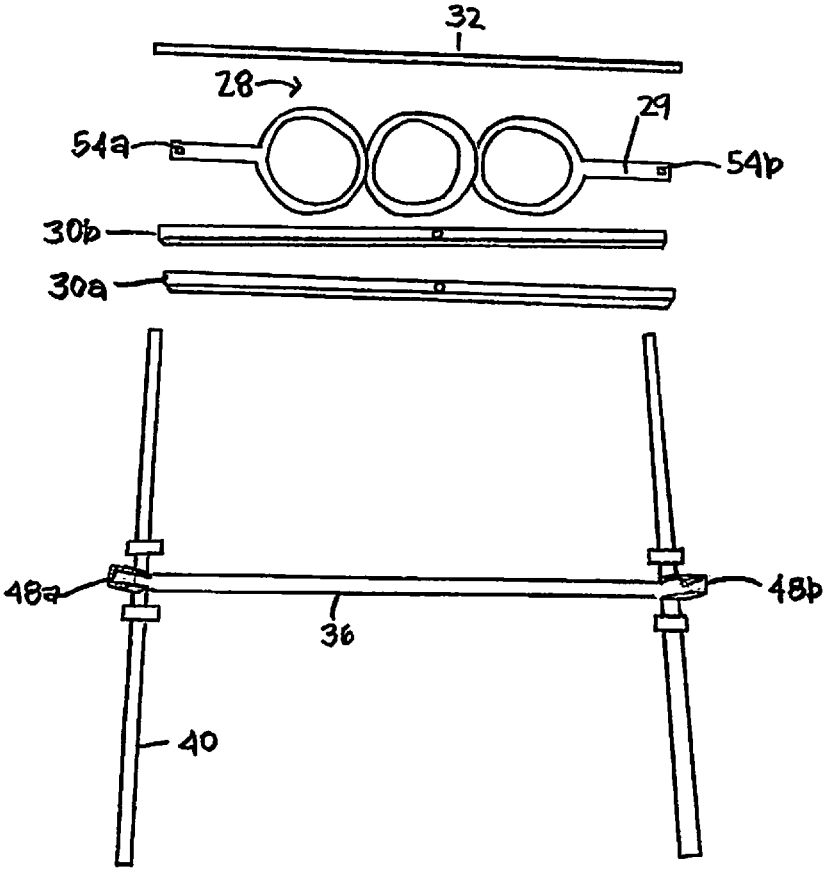
FIG. 17 is a partially exploded top view of the device of FIG. 20.
Figure 18:
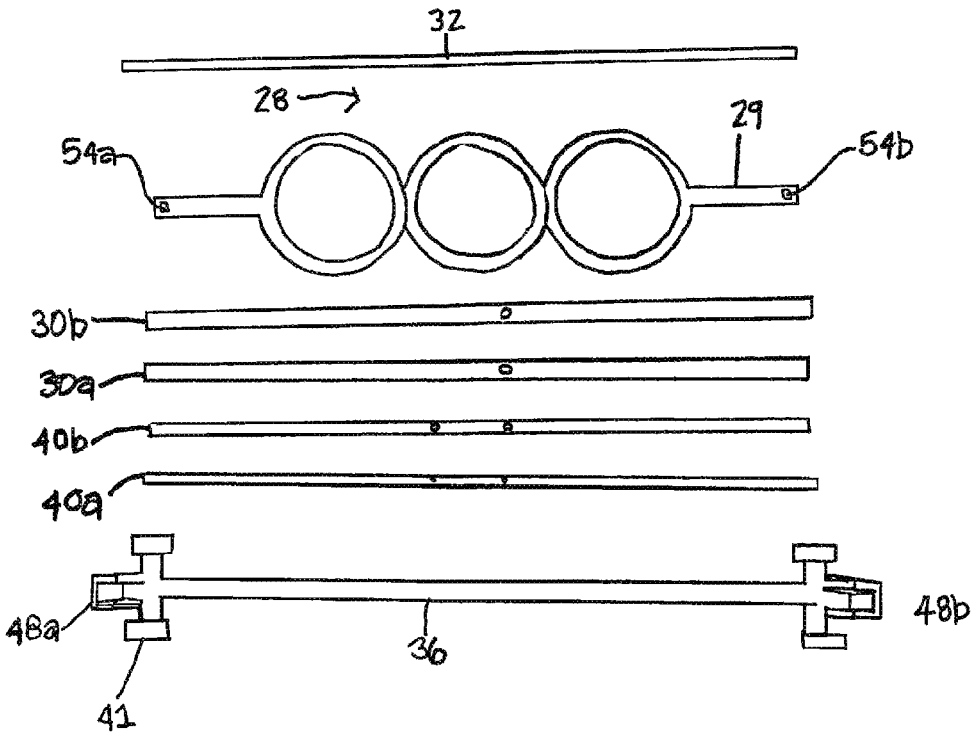
FIG. 18 is an exploded top view of the device of FIG. 20.
Figure 19:
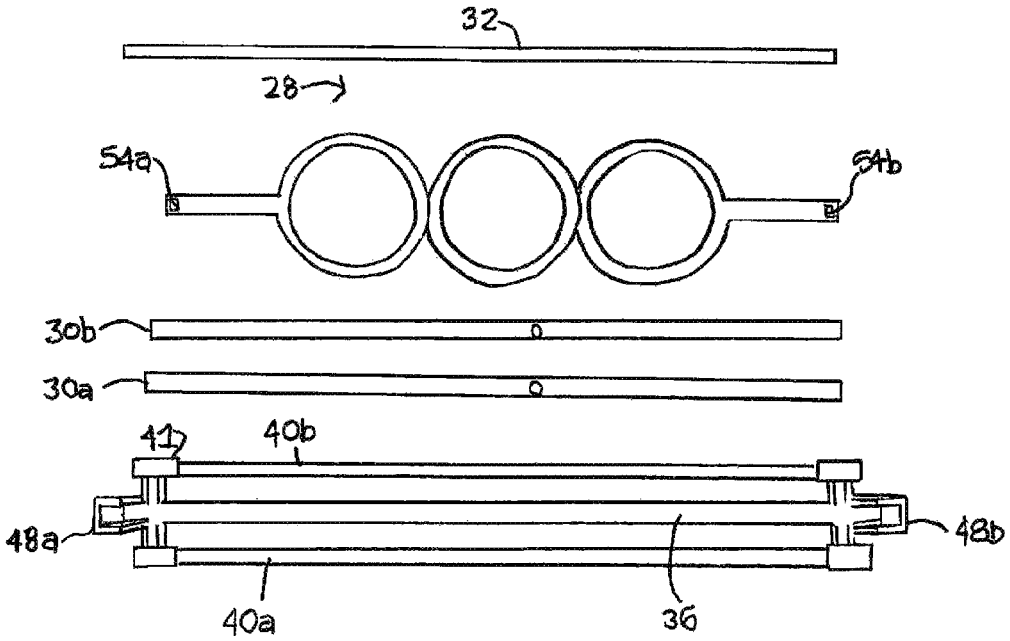
FIG. 19 is a partially exploded top view of the device of FIG. 20 of a further assembly aspect in accordance with the invention.

Device 20 includes a base 50 which supports legs 30*a*, 30*b* and also receives feet 40. Base 50 comprises horizontal support 36, foot connectors 46, foot holders 41 and leg sleeves 48. Base 50 (best seen in FIGS. 14 and 15) receives feet 40 by sliding feet 40 through foot connectors 46 (FIG. 14) running perpendicular to horizontal support 36. FIG. 14 shows base 50 in an upside-down position for clarity. In one aspect foot connectors 46 are U-Channels 46 with the major opening of the channel oriented toward the ground surface. In one aspect feet 40 are secured via friction fit within U channels 46. A U-channel 46 may also straddle a foot 40. Foot connectors 46 may also be configured to receive feet 40 by plugging or other connection, or by sliding within a tubular foot connector similar to foot holders 41. The weight of device 20 also secures feet 40 into position. Feet 40 along with channels 46 give device 20 support from tipping over or sliding. Weights can be placed on feet 40 to provide even more resistance to tipping or sliding. Vertical legs 30 slide into leg sleeve 48 and are secured by a pin, bolt, screw, etc. Horizontal support 36 is welded or connected by other means to the bottom of leg sleeve 48 (FIG. 15), or leg sleeve 48 is connected to an end of support 36. In one aspect horizontal support 36 and U Channels 46 all contact a level surface. In other aspects support 36 is slightly raised from a ground surface. In one aspect device 20 has horizontal support 36 positioned near but not on the ground to provide clearance for channels 46. Foot 40, horizontal support 36 and vertical leg 30 connect at base 50. In one aspect legs 30, feet 40 and hoop segment 28 are all of the same length to ensure a compact folded structure. Having the same lengths allow the components (vertical legs 30 and hoop segment 28) to be conveniently and securely placed between leg sleeves 48*a*, 48*b*.

Figure 2:
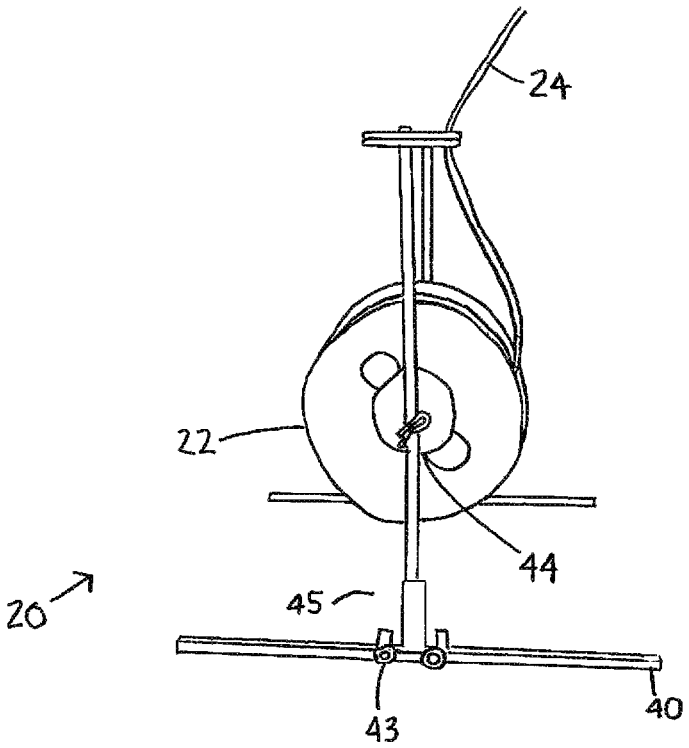
FIG. 2 is a side view of a spool holder of FIG. 1 with an alternative hoop aspect.

FIG. 2 shows device 20 in its operational form from a side view. Electrical wire 24 can be pulled out from either side (or any direction) of the hoop segment 28. Spool 22 may also be situated so the wire 24 can come out of either side of the spool and spin clockwise or counterclockwise. Foot 40 runs perpendicular to horizontal support 36. In one aspect the length of foot 40 is the same length as vertical legs 30, giving device 20 stability from tipping in either direction and making compact folding or storage easier. Base 50 also lends support to device 20 by securing feet 40 and horizontal support 36. Feet 40 run through base 50, and in one aspect are connected via a friction fit channel 46. Clearance height "B" between spool 22 and hoop segment 28 can be further appreciated to reduce torque, wire bending and tipping of the device 20. In one aspect spool 22 has a spool wheel 23 of 14 inches in diameter while height "B" measures at least 7 inches and in one example measures 10 inches. Height "B" in some aspects is longer than 10 inches. The height "B" may also depend on the diameter of spool 22. In one aspect height "B" measures at least one-half the diameter of spool 22. In other aspects height "B" measures much more than one-half the diameter of spool 22. A pin 44 holds spool 22 in place on horizontal axle 32.

Figure 3:
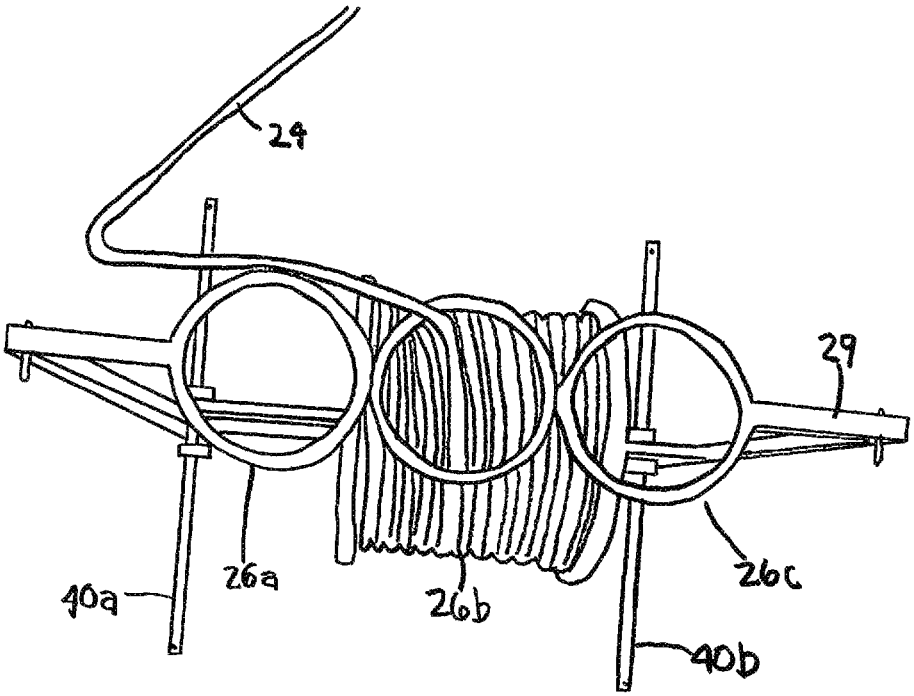
FIG. 3 is a top view of a spool holder of FIG. 1.

FIG. 3 shows device 20 in operational mode from top view. Electrical wire or cable 24 is fed through hoop segment 28 in any direction. Hoops 26 are wide hoops that help wire pass through smoothly. Wire can pass through any of the hoops. Hoops 26*a*, 26*b* and 26*c* are welded together to make up hoop segment 28. In this aspect, hoop segment 28 connects to hoop bar 29, with hoop bar 29 having a length of at least half of the length of spool 22. The length of bar 29 in this aspect allows wire 24 to be dispensed from an operator located directly on the side of device 20 without spool 22 rubbing against vertical leg 30. This, combined with the width "C" of hoops 26, and clearance "B" make wire dispensing as smooth as possible. Device 20 may be placed inside a building to be wired (or outside if desired). A user may pull upon wire 24 from any direction (or substantially any direction) of the building to efficiently unwind the wire 24. A pulling force along wire 24 in the direction parallel horizontal axle 32 will nonetheless result in unwinding of spool 22 even though the force is parallel support 32. This is due to a sufficient the height "B" clearance and wide hoop diameter to allow favorable angled unwinding of wire 24 from spool 22. Of course, a pulling force coming from a more upward angle will allow spool 22 to spin more easily and have less of an incident angle which will make it less likely for cable 24 to bend or improperly buckle. Typically cable 24 is dispensed from device 20 in an upward direction shown in the dotted line of FIG. 4. It may be appreciated that the angle of the cable 24 (and dotted line) may vary greatly and in typical cases may extend to the other side (left side) of hoop 26 compared to the orientation shown in FIG. 4.

Figure 5:
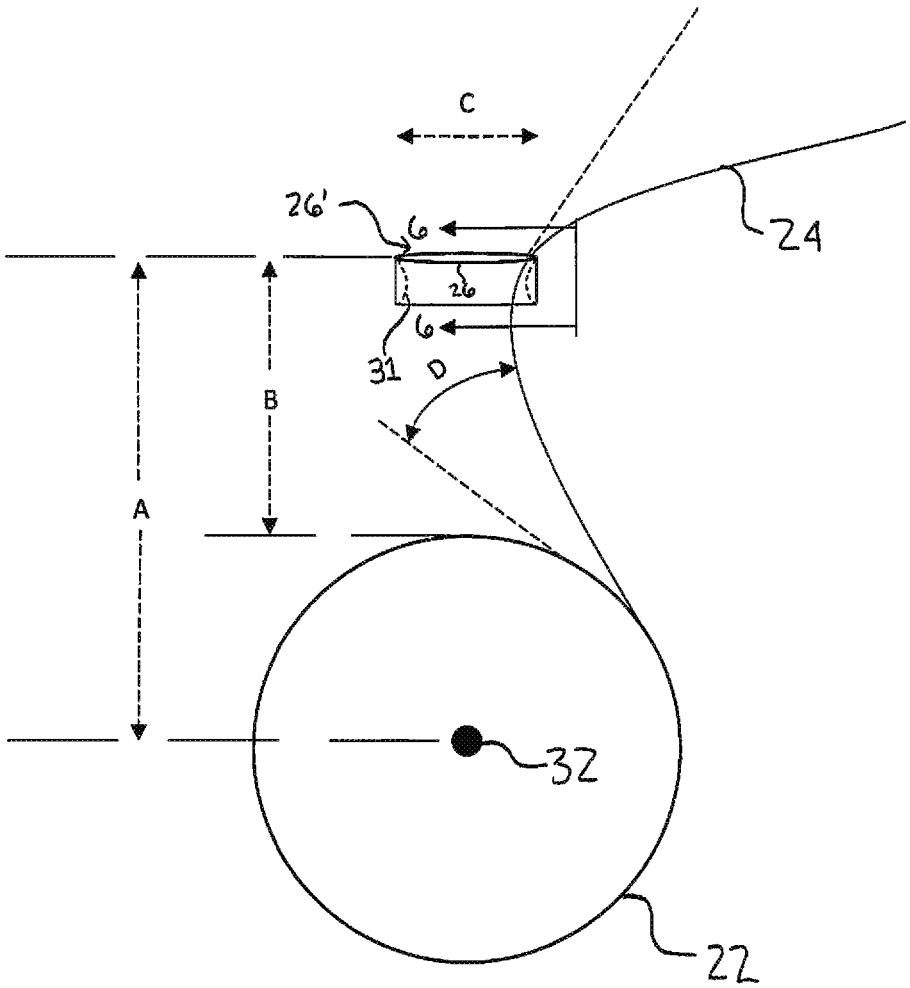
FIG. 5 is a schematic drawing of alternative representative aspects of the device of FIG. 1.
Figure 6:
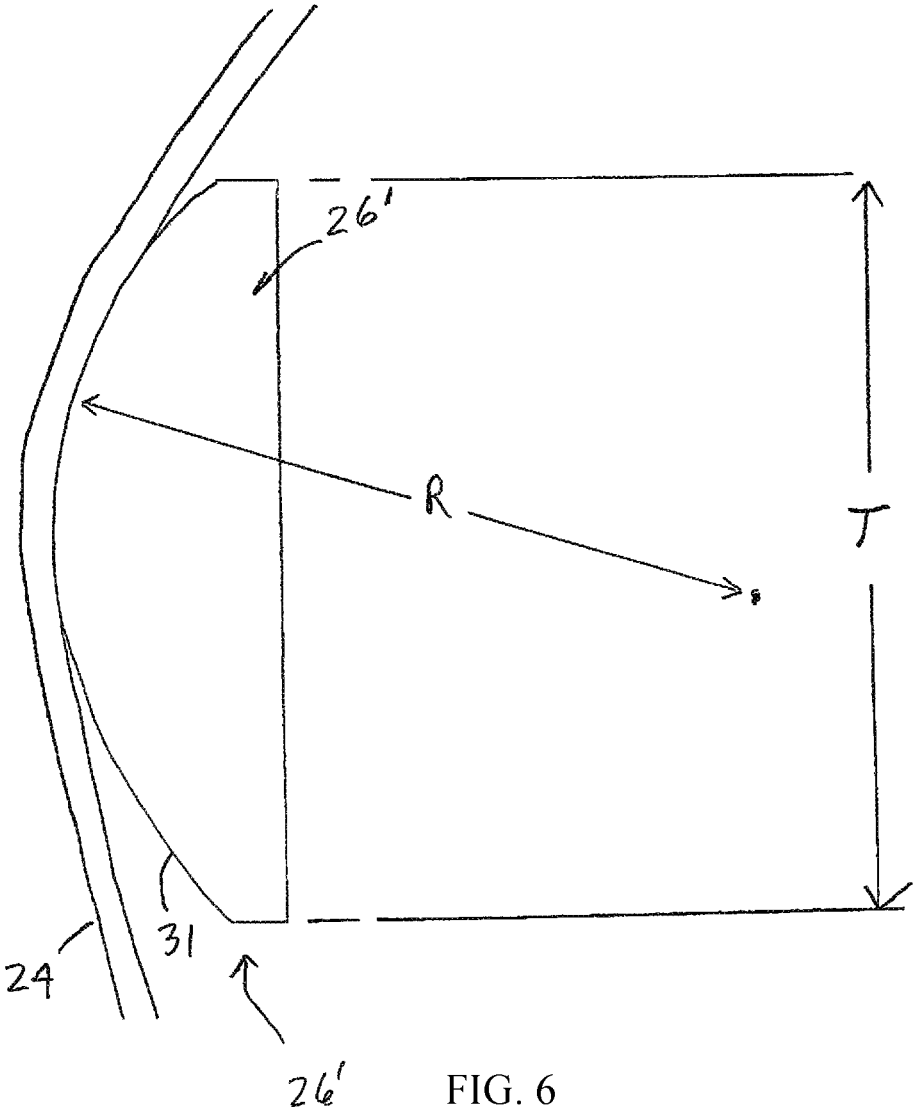
FIG. 6 is a partial section view taken along line 6-6 of FIG. 5.
Figure 7:
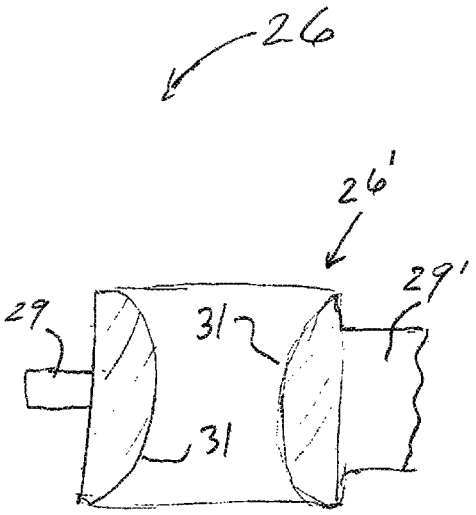
FIG. 7 is an alternative partial section view of a component in accordance with further aspects of the invention.

In other aspects as shown in FIGS. 5-7, hoop 26' has a relatively large thickness "T". Such thickness "T" allows for an internal cable contact surface 31 within hoop 26' to achieve a relatively large radius "R" along a greater surface area within hoop 26' to accommodate smooth bending of cable 24. A larger or smaller radius R may be used for hoop 26'. The radius R may also vary throughout the thickness T of the hoop 26'. A larger radius allows for passing a variety of different types and sizes of wire or cable 24 or other wound material through and/or in contact with hoop 26' while maintaining compliance with bend radius best practices or requirements. The radius R may be configured so that a variety of types of cables 24 will be compliant when passed through hoop 26'. In one aspect, radius R may measure 3 inches where thickness T is also 3 inches. Different values for radius R and thickness T may also be used as desired. In one aspect radius R measures 6 inches where thickness T is also 6 inches. In other aspects the radius R is different compared to the thickness T, and may be smaller or larger compared to thickness T. Radius R may be much larger than 6 inches as desired. Thickness T may be much larger than 1 inch as desired.

Hoop 26' in one aspect is generally doughnut shaped where cable 24 passes through the center of hoop 26'. Hoop 26' is made of plastic in one aspect and can be shaped into a desired form. FIG. 6 shows a partial cross section view taken along line 6-6 of FIG. 6. Cable 24 abuts internal cable contact surface 31 having a radius R which accommodates gradual bending of cable 24 which also allowing smoot unwinding of cable 24 from spool 22. Surface 31 may be treated with low friction material or may be made of hardened plastic or other material or processing that has a natural low friction characteristic to allow cable 24 to slide easily. In other aspects rollers or bearings or a series of rollers or bearings such as needle bearings or other friction reducing means may be used for, or incorporated into, contact surface 31. FIG. 7 is an alternative partial section view of hoop 26' showing contact surfaces 31. Additional hoops 26, 26' may be combined with hoop 26' at hoop segment 28. A hoop bar 29 or thickened hoop bar 29' in one aspect is used to connect hoop 26' or hoops 26 with segment 28. As shown in FIG. 5, a lower portion of hoop 26' is located above spool 22 at least ½ the diameter of spool 22. In some aspects such height is determined by use of legs 30 which measure the same or about the same distance as the length of hoop segment 28 and/or horizontal support 36, and foot 40 for ease of compact storage. In other aspects hoop 26, 26' is positioned closer to spool 22.

Figure 20:
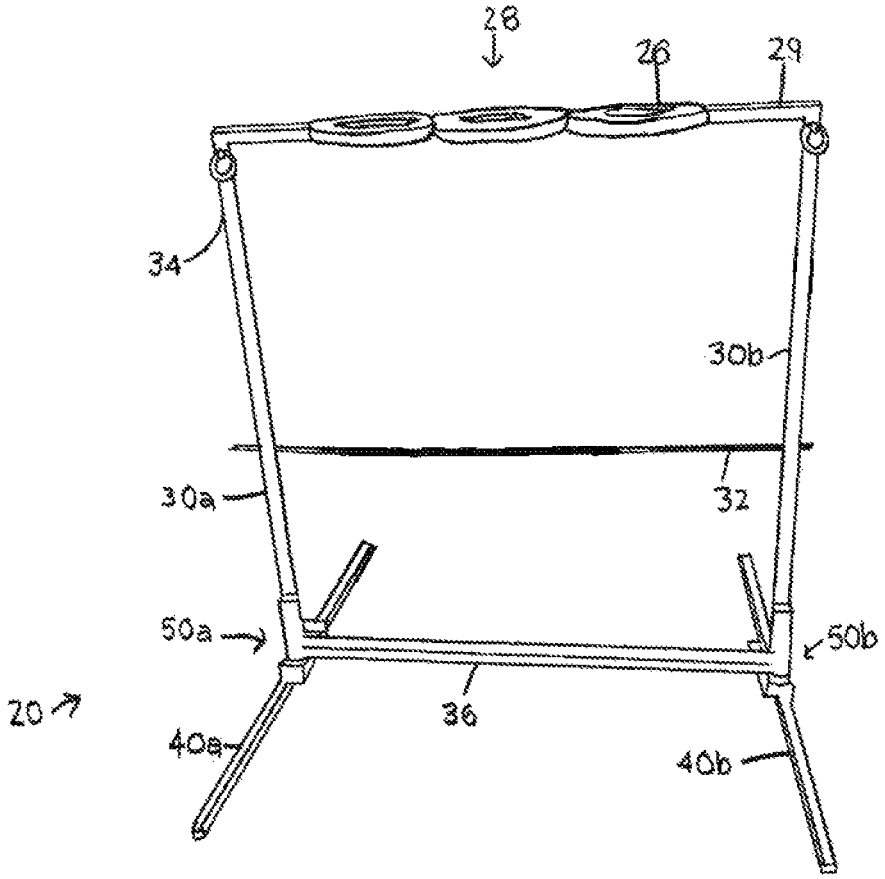
FIG. 20 is a front perspective view of a fully assembled frame device made in accordance with one aspect of the present invention.

FIG. 20 is a front perspective view of a fully assembled frame device made in accordance with one aspect of the present invention. FIGS. 9-13 show device 20 in a collapsed form from different views. Feet 40 slide out from channel 46 and are inserted into foot holder 41 (see also FIG. 19) which run parallel to hoop segment 28 on either side of horizontal support 36. In one aspect plugs 54 extend downward from the end of hoop bar 29. Hoop segment 28 is removed by lifting segment 28 from vertical legs 30*a*, 30*b*. Vertical legs 30 disconnect from leg sleeves 48*a*, 48*b* (by removal of connectors 34) and are then placed horizontally into sleeves 48*a*, 48*b* such that legs 30*a*, 30*b* span from sleeve 48*a* to sleeve 48*b* (see FIG. 12). In one aspect hoop segment 28 is turned upside-down such that bar 29 rests upon leg 30 and segment spans between sleeves 48*a*, 48*b* and such that plugs 54*a*, 54*b* insert into leg sleeves 48*a*, 48*b* (See FIG. 13). Horizontal axle 32 slides into base hole 52 and through vertical leg 30 for compact storage.

Figure 13:
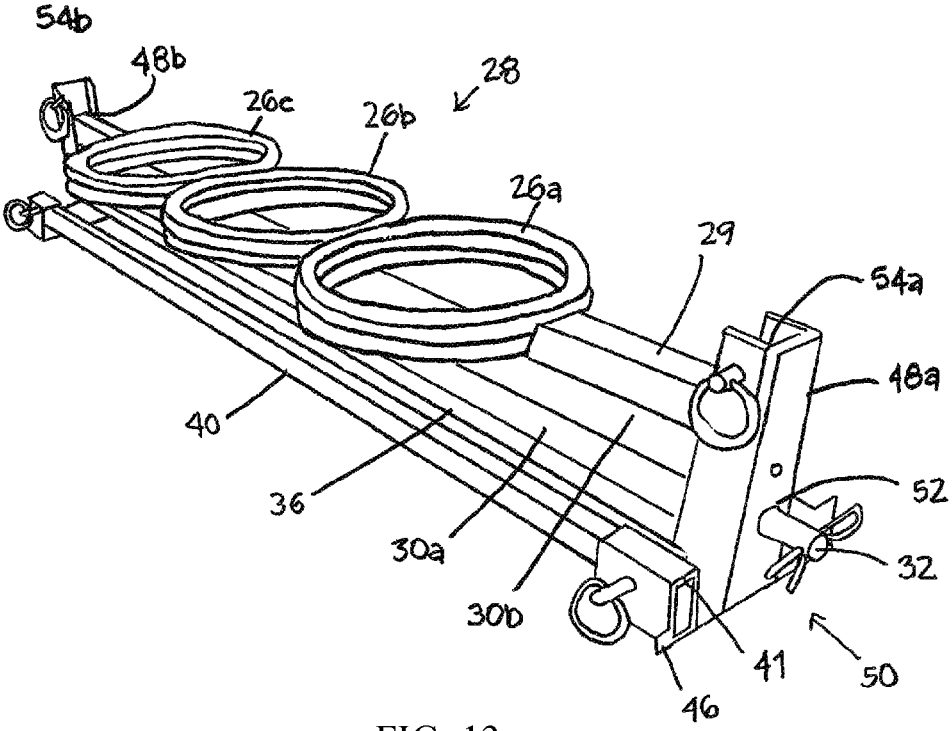
FIG. 13 is a perspective view of the folded frame device of FIG. 9.

Device 20 is compactly stored upon or within its own base 50. Device 20 is assembled/disassembled quickly, is compact and user friendly. The compact form is convenient to store in a vehicle and packaged for distribution or storage. Device 20 is quickly disassembled into separate parts. FIGS. 16, 17, 18, and 19 show a stepwise process for putting device 20 into its folded form. One way of disassembly of the device 20 shown in FIG. 20 is by removing pin 34, sliding horizontal axle 32 out of spool 22. Next, connector 34 is removed from vertical legs 30*a* and 30*b* and vertical legs are removed from plugs 54 attached to hoop bar 29. Then hoop bar 29 and hoop segment 28 are detached from device 20. Once pins 45 (See FIG. 2) are removed, vertical legs 30*a* and 30*b* can be disassembled. Pins 43 are removed and feet 40*a* and 40*b* are removed from channels 46*a* and 46*b*. The device can be assembled by reversing the steps. From FIG. 19, the device 20 can be assembled into a compact form as shown in FIG. 13. Feet 40 are slid into foot holder 41 and pinned in place. Either vertical leg 40*a* or 40*b* is put into leg sleeve 48 and rests on top of horizontal support 36. Leg 40 aligns with base hole 52 and horizontal axle 32 is fed through base hole 52 and into vertical leg 40. The other vertical leg is put into leg sleeve 48 and rests on top of the other vertical leg 40. Hoop bar 29 and hoop segment 28 are put into leg sleeve 48 with connector 34 being above hoop bar 29 and hoop segment 28. Plugs 54 protrude from hoop bar 29 and hoop segment 28 leading to the upside down position of the top segment in the most compact form.

In one aspect legs 30, feet 40, horizontal support 36 and hoop segment 28 are all of the same length. Equal lengths are most helpful when it comes to folding device 20. If feet 40 are shorter than horizontal support 36, then feet 40 will not will not be able to fit into foot holders 41*a* and 41*b* simultaneously. Likewise, vertical legs 30 and top portion 25 will not be able to span from leg sleeves 48*a* to 48*b*. In one aspect the length for these segments is no less than 24 inches. A length of 24 inches is long enough to form a desired distance "B" between spool 22 and hoop segment 28 but not too long to be inefficient and bulky even in the folded form. In one aspect, the invention measures 27 inches long, measured along feet 40, 27 inches wide, measured from leg sleeve 48*a* to leg sleeve 48*b*, and 27-29 inches high, measured from the ground to hoop bar 29. Legs 30, which in one aspect are 27 inches long, rest upon horizontal support 36 in the assembled position of FIG. 20, thus resulting in a total device height of about 28 or 29 inches.

Feet 40 in conjunction with foot connectors or U-Channels 46 provide a solid foundation for supporting device 20. U-Channels 46 have a length of about 6 inches and sit upon feet 40. Because feet 40 lay flat upon the ground surface, and U-channels 46 a placed upon the grounded feet 40, a substantially stable support is achieved for holding reel 22 and accommodating efficient unwinding of wire 24 from a variety of directions.

It should be understood, of course, that the foregoing relates to exemplary embodiments of the invention and that modifications may be made without departing from the spirit and scope of the invention as set forth in the following claims.

What is claimed is:

1. A device configured to hold a spool of wound material where the wound material has a diameter, the spool having a spool diameter, said device comprising:

a horizontal support;

a horizontal axle positioned above the horizontal support and configured to support the spool; and a hoop segment having a hoop and positioned above the horizontal axle, the hoop configured to guide cable dispensed from the spool, the hoop having an opening diameter of at least three inches.

2. The device of claim 1 where the device contains at least two hoops positioned above the horizontal axle.

3. The device of claim 1 where the hoop is placed a distance of at least half the spool diameter above the spool.

4. The device of claim 1 where the hoop is made of at least two stacked rings.

5. The device of claim 1 where the spool spins freely about and slides freely along the horizontal axle.

6. The device of claim 1 where the horizontal support is part of a base, the base further comprising a pair of foot connectors, a pair of leg sleeves and a pair of foot holders.

7. The device of claim 6 further comprising a pair of feet configured to fit within the foot connectors and alternatively in the foot holders, the device further comprising a pair of vertical legs, each leg configured in an assembled mode to connect to the base at one end of the leg and connect to a hoop segment at an opposite end of the leg and in a storage mode to connect to the base between a pair of leg holders.

8. The device of claim 1 where the hoop has a diameter of at least six inches.

9. The device of claim 1 where the hoop segment comprises an uppermost segment of the device.

10. The device of claim 1 where the horizontal support is part of a base, the base further comprising a pair of foot connectors configured to removably hold feet and a pair of foot holders configured to hold the feet when the feet are removed from the foot connectors.

11. The device of claim 1 further comprising:

a pair of legs extending vertically and connected to the hoop segment; and a pair of feet positioned below the pair of legs and extending generally perpendicularly to the pair of legs, the feet having a length substantially the same as a maximum length of the legs.

12. A spool holding device configured to fold upon itself in a storage mode and configured to support a spool of wound material in an operation mode, the device comprising:

a base, the base comprising;

a horizontal support;

a first foot connector positioned at a first end of the horizontal support and a second foot connector positioned at a second end of the horizontal support; and a first leg sleeve positioned at the first end of the horizontal support and a second leg sleeve positioned at the second end of the horizontal support;

a first vertical leg associated with the first leg sleeve and a second vertical leg associated with the second leg sleeve;

a hoop segment having at least one hoop, the hoop having an opening diameter of at least three inches, and configured to span between the first vertical leg and the second vertical leg;

a horizontal axle configured to span between the first vertical leg and the second vertical leg and configured to receive a spool of material to be wound or unwound;

a first foot associated with the first foot connector and a second foot associated with the second foot connector; and a first foot holder configured to hold the first foot when the first foot is removed from the first foot connector and a second foot holder configured to hold the second foot when the second foot is removed from the second foot connector.

13. The device of claim 12 where the first foot connector is a U-channel and the second foot connector is a U-channel, the first U-channel configured to receive the first foot.

14. The device of claim 13 where the U-channel is configured such that an entirety of the first foot contacts a ground surface when the device is assembled.

15. The device of claim 12 where the first and second leg and the hoop segment stack within the base.

16. The device of claim 12 where the base is configured such that the first leg spans from the first leg sleeve into the second leg sleeve when the first leg is stored on the base.

17. The device of claim 12 where lengths of the first and second legs and the hoop segment are substantially equal.

18. A spool holding device comprising:

a base having a horizontal support;

a pair of feet extending from the base perpendicularly to the horizontal support;

a pair of legs extending upward from the base perpendicularly to the horizontal support;

a horizontal axle connected to and spanning between the pair of legs; and a hoop segment connected to ends of the legs and oriented parallel to the horizontal support, the hoop segment containing at least one hoop, the hoop having an opening diameter of at least three inches, and configured to receive a flexible linear material to be unwound from a spool held by the horizontal axle, the legs, the hoop segment and the horizontal axle are detachably connected to the device and stack upon the base in a storage mode.

19. The device of claim 18 where the horizontal axle is positioned a first distance upward from the horizontal support in an operational mode and the hoop segment is oriented a second distance from the horizontal support, the second distance being greater than twice the first distance.

20. The device of claim 18 where the horizontal axle is positioned a first distance upward from the horizontal support in an operational mode and positioned through at least one of the legs in a storage mode, the at least one of the legs positioned horizontally upon the base in the storage mode.

* * * * *